United States Patent [19]

Zibung

[11] Patent Number: 4,540,232

[45] Date of Patent: Sep. 10, 1985

[54] TERMINAL BOX APPARATUS

[75] Inventor: Rene A. Zibung, Bordeaux, South Africa

[73] Assignee: Swisstronic (Proprietary) Limited, Transvaal, South Africa

[21] Appl. No.: 577,797

[22] Filed: Feb. 7, 1984

[30] Foreign Application Priority Data

Feb. 18, 1983 [ZA] South Africa ..... 83/1108

[51] Int. Cl.[3] ..... H01R 9/09; H01R 9/24

[52] U.S. Cl. ..... 339/198 G; 339/17 M; 339/266 R

[58] Field of Search ..... 339/17 R, 17 C, 17 LM, 339/17 M, 198 R, 198 G, 198 GA, 198 H, 266 R

[56] References Cited

U.S. PATENT DOCUMENTS 4,175,820 11/1979 Wilmes et al. ..... 339/198 G

*Primary Examiner*—Neil Abrams

*Attorney, Agent, or Firm*—Birch, Stewart, Kolasch & Birch

[57] ABSTRACT

This apparatus includes a series of terminal boxes having a base and a detachable lid. Each accommodates a PCB. The terminal boxes are shaped to nest neatly alongside one another. Electrical interconnection between PCB terminals in adjacent terminal boxes is achieved by way of conductive straps which are located partially in a recess in the base of one terminal box and partially in an aligned recess in a neighboring terminal box. Conductive pins extending from the PCB terminals into the base, where they engage the ends of the straps, complete the connections. Provision is also made for connection of the PCBs to external devices, such as switches, batteries and so on. In all cases, the straps, PCBs and pins are concealed so the apparatus is neat and orderly in appearance.

4 Claims, 5 Drawing Figures

FIG _1
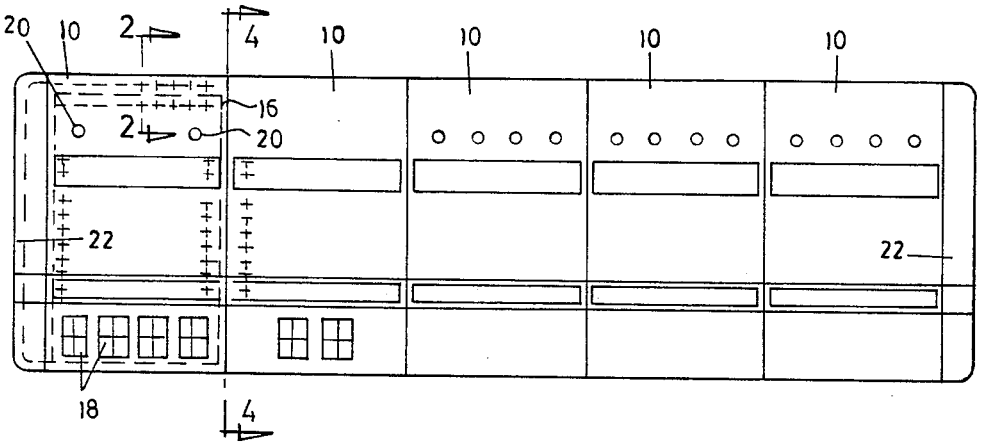
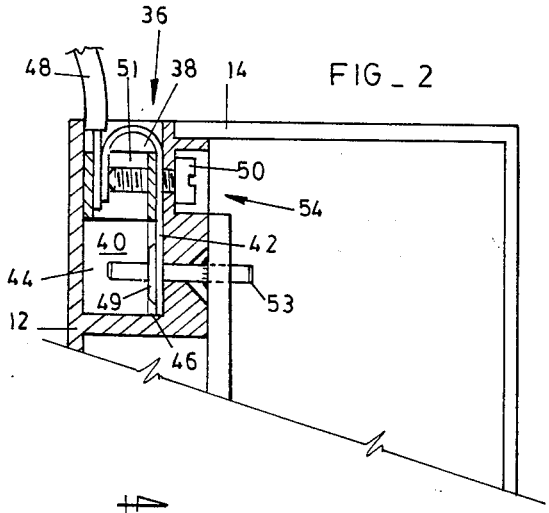
FIG _ 2
FIG _3
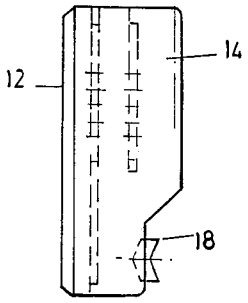
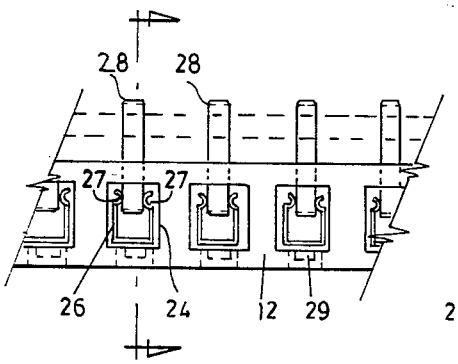
FIG 4.
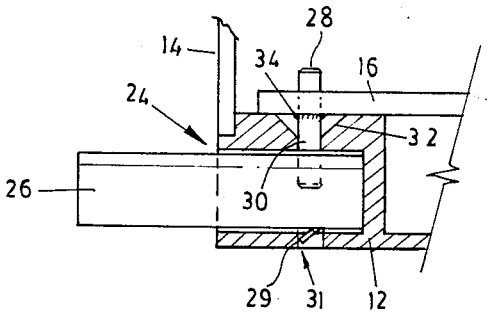
FIG _5

TERMINAL BOX APPARATUS

BACKGROUND TO THE INVENTION

This invention relates to a terminal box apparatus, each terminal box of the apparatus serving in use to accommodate a PCB (printed circuit board).

Up to now, when a number of PCBs have to be linked together to provide continuous circuitry, their individual terminal boxes have generally been arranged haphazardly with a multitute of individual wires extending between the terminal boxes from the terminals of the PCB in one box to the terminals of the PCB in an adjacent box. The actual connections with the terminals of the PCB are usually made via holes formed arbitrarily in the wall of the terminal box. Haphazard interconnection techniques are especially prevalent in the electronic circuitry assembly by hobbyists.

The present invention has as an object to provide apparatus whereby electrical connections between individual PCBs and between PCBs and external devices such as switches, batteries, etc is achieved in a simple and orderly manner.

SUMMARY OF THE INVENTION

A terminal box apparatus including at least one terminal box having a base for supporting a PCB, the base being shaped to nest alongside the bases of other similar boxes, one or more lids for covering the PCBs, a plurality of conductive straps each locatable partially in a recess formed in the base of the terminal box and partially in an aligned recess formed in the base of an adjacent similar terminal box, and a plurality of conductive pins each for securance to a PCB and each for passage through a hole in a part of the base of the terminal box into releasable, electrical engagement with one end of a strap to hold the PCB to the base and to establish an electrical interconnection between a terminal of the PCB and a terminal of a PCB in the adjacent terminal box via the strap.

Preferably, the apparatus also includes a plurality of further conductive straps each for accommodation in a recess in the base, and a plurality of further pins each for secural to the PCB in electrical contact with a terminal of the PCB and each for passage through a part of the base into releasable engagement with one end of a further strap to hold the PCB on the base and establish an electrical interconnection between the terminal of the PCB and an external device connected electrically in use to the other end of the further strap.

The external device could be, for instance, a battery, a switch or the like.

BRIEF DESCRIPTION OF THE DRAWINGS

FIG. 1 is a front view on a series of terminal boxes of an apparatus according to this invention;

FIG. 2 is a section at the line 2—2 of FIG. 1;

FIG. 3 is an end view on a terminal box;

FIG. 4 is a section at the line 4—4 in FIG. 1; and

FIG. 5 is a section at the line 5—5 in FIG. 4.

DESCRIPTION OF A PREFERRED EMBODIMENT

The illustrated apparatus includes a series of individual terminal boxes 10, each of which has a base 12 and a lid 14 as can be seen in FIG. 3. In use, each terminal box accommodates a PCB 16 (shown in broken outline in FIG. 1). A series of rocker switches 18 and LED displays 20 are mounted on each terminal box.

Each terminal box can mate with terminal boxes to either side of it. For this purpose, each base has on one side one or more tongue projections (not shown) and on the other side one or more recesses, the tongue projections being sized to clip into the recesses of neighbouring bases. End pieces 22 are clipped to the outermost bases to provide a pleasing finish.

As an alternative to the provision of a lid for each base, it is possible for there to be lids each dimensioned to cover two or more bases. In each case, the lids and bases carry formations enabling them to be clipped together.

Each terminal box is provided along its side edges with a series of recesses 24 which extend into the base 12 of the terminal box. These recesses can be seen in FIGS. 4 and 5. When the terminal boxes are arranged as in FIG. 1, the recesses 24 in one terminal box align with the recesses 24 in the adjacent terminal box. A strap 26 of conductive metal, such as copper or brass, is accommodated partially in the recess 24 of the one terminal box and partially in the recess 24 of the adjacent terminal box. The straps have the cross-sectional shape shown in FIG. 4, with inwardly directed lips 27 spaced a short distance apart from one another. A small tab 29 is pressed out from the material of each strap near to its end. When the straps are pushed home in the recesses 24, these tabs locate positively in small holes 31 formed through the base 12, and then can not be removed without first deforming the tabs 29 resiliently by inserting a narrow tool, such as a screwdriver through the hole 31 to press on the tab.

Secured to the PCB in each terminal box is a series of conductive pins 28. The pins 28 project above the plane of the PCB for electrical connection to terminals of the PCB, and extend through holes 30 in the base of the terminal box. The holes 30 are countersunk at 32 to provide room for solder 34 which serves to secure the pins to the PCB. By pressing downwardly, the pins 28 are engaged frictionally between the opposed lips 27 of the straps 26.

The pins therefore serve the dual function of holding the PCB down onto the base and of establishing an interconnection between the terminals of PCBs in adjacent terminal boxes, via the straps 26. The terminal boxes can therefore be interconnected to form continuous circuitry merely by securing the pins to the PCB with the desired electrical connections, and then pressing the pins through the holes 30 and between the lips 27.

An equally simple arrangement is provided for connecting the terminals of the PCB in each terminal box to external devices, such as switches, batteries, and so on (not illustrated). A series of recesses 36 are formed in the operatively upper edge of the base of each terminal box. The recesses 36 extend into the base for a first portion 38 of rectangular cross-section and for a second portion 40 of T-shaped cross-section, the webs 44 of the T-shapes extending towards the bottom of the base, and the cross-pieces 46 of the T-shapes being spaced from the bottom as shown.

Flat straps 42 are located in the recesses. The straps 42 have widths greater than the width of the webs 44 of the T-shapes and so are retained in the cross-pieces. Near their inner ends, the straps are formed with holes 49 shaped to provide locking dogs. The outer ends of the straps are bent over as shown over and into a hollow rectangular cage 51 of conductive material located in the recess portion 38. The base of the terminal box is holed at 54 to take a screw 50. The screw 54 passes through a hole 54 and into the cage, where it can be tightened up to sandwich a contact at the end of a wire 48 extending from the external device between the bend-over part of the strap and the cage as shown.

At the other end of the straps 42, the pins 53 secured to the PCB are pressed home through the locking dogs provided by the holes 49 and into the webs 44 of the T-shapes, in each case making an electrical connection between a wire 48 extending from an external device and the relevant PCB terminal.

It will be appreciated that once all the required electrical connections have been made between neighbouring terminal boxes the straps 26 and 42 and pins will not be visible and the resulting assembly of terminal boxes will have a pleasing and neat appearance. Of course, although there is provision for ten connections between PCBs on each of the illustrated terminal boxes, not all of these possible connections will be employed in every application.

Similarly, there is provision for ten connections to external devices, but not all of these will be used in every application of the apparatus.

The terminal boxes 10 can be mounted side-by-side on a backing board or tray, and provision may be made in the bases for screws or bolts for use in the mounting operation, or they may be adapted to be clipped onto a clip tray.

The apparatus of the invention has a wide range of possible applications. One application in which the apparatus would be especially useful is a burglar alarm system, where extra terminal boxes could be added to an existing circuit arrangement at will when the alarm system is to be expanded by the addition of further alarm devices.

An advantage of the apparatus is the fact that defective PCBs can be replaced with little difficulty and with no need for specialised tools. The defective PCB is taken out merely by withdrawing its pins and the replacement PCB is plugged in its place.

I claim:

1. A terminal box apparatus including at least one terminal box having a base for supporting a PCB, the base being shaped to nest alongside the bases of other similar boxes, one or more lids for covering the PCB, a plurality of conductive straps each locatable partially in a recess formed in the base of the terminal box and partially in an aligned recess formed in the base of an adjacent similar terminal box, and a plurality of conductive pins each for securance to the PCB and each for passage through a hole in a part of the base of the terminal box into releasable, electrical engagement with one end of one of the straps to hold the PCB to the base and to establish an electrical interconnection between a terminal of the PCB and a terminal of a PCB in the adjacent terminal box via the strap.

2. The apparatus of claim 1, including a plurality of further conductive straps each for accommodation in a further recess in the base, and a plurality of further pins each for securance to the PCB in electrical contact with a terminal of the PCB and each for passage through a part of the base into engagement with one end of one of the further strap to hold the PCB on the base and establish an electrical interconnection between the terminal of the PCB and an external device connected electrically in use to the other end of a further strap.

3. The apparatus of claim 1, in which the straps have basically a U-shape in cross-section with inwardly directed lips at the free ends of the U-shape for engaging a pin frictionally when the pin is pressed between the lips.

4. The apparatus of claim 2, in which the further straps are flat and are each formed with a hole shaped to detain one of the further pins when the further pin is pressed into the hole.

* * * * *